US006703983B2

(12) United States Patent
Huang

(10) Patent No.: US 6,703,983 B2
(45) Date of Patent: Mar. 9, 2004

(54) SLOT ANTENNA HAVING IRREGULAR GEOMETRIC SHAPE

(75) Inventor: Chien Shun Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/999,849

(22) Filed: Oct. 25, 2001

(65) Prior Publication Data

US 2003/0043083 A1 Mar. 6, 2003

(30) Foreign Application Priority Data

Aug. 29, 2001 (TW) ..... 90121321 A

(51) Int. Cl.[7] ..... H01Q 13/10
(52) U.S. Cl. ..... 343/768
(58) Field of Search ..... 343/768, 767, 343/770, 702

(56) References Cited

U.S. PATENT DOCUMENTS

| | | | | | |
|---|---|---|---|---|---|
| 2,935,747 | A | * | 5/1960 | Ghose | 343/767 |
| 3,623,162 | A | * | 11/1971 | Whitty | 343/767 |
| 3,631,500 | A | * | 12/1971 | Itoh | 343/767 |
| 5,600,337 | A | * | 2/1997 | Cassel | 343/770 |
| 5,900,843 | A | * | 5/1999 | Lee | 343/767 |
| 6,218,997 | B1 | * | 4/2001 | Lindenmeier et al. | 343/767 |
| 6,404,394 | B1 | * | 6/2002 | Hill | 343/767 |

* cited by examiner

*Primary Examiner*—Michael C. Wimer
(74) *Attorney, Agent, or Firm*—Wei Te Chung

(57) ABSTRACT

A slot antenna (1) for an electronic device includes an antenna body (10) with a slot (11) defined therein and a coaxial feeder cable (2) electrically connected to the antenna body. The antenna body has variously shaped notches and holes cut near the slot for improving operating characteristics of the slot antenna.

10 Claims, 3 Drawing Sheets

| (GHz) | Max.Gain(dBi) | Avg.Gain(dBi) |
|---|---|---|
| 2.40 | -0.58 | -6.91 |
| 2.45 | -2.03 | -7.59 |
| 2.50 | -1.70 | -6.72 |

| (GHz) | Max.Gain(dBi) | Avg.Gain(dBi) |
|---|---|---|
| 2.40 | -2.90 | -7.52 |
| 2.45 | -4.23 | -8.28 |
| 2.50 | -3.44 | -6.98 |

SLOT ANTENNA HAVING IRREGULAR GEOMETRIC SHAPE

FIELD OF THE INVENTION

The present invention relates to a slot antenna, and in particular to a slot antenna having an irregular geometric shape.

BACKGROUND OF THE INVENTION

There is a growing need for slot antennas for use in wireless communication devices. Referring to FIG. 1, a conventional slot antenna comprises a rectangular antenna body made from a metal foil, an elongated, narrow slot defined in the antenna body and a coaxial cable electrically connecting with the antenna body, wherein the cable has an inner core wire soldered to one side of the slot and an outer shield soldered to another side of the slot. The antenna body generally has a regular geometric shape.

However, when such a conventional slot antenna is mounted in an electronic device, the directionality of the slot antenna, and specifically the receiving angle and the gain value of the slot antenna, are affected by the geometric shape of the antenna itself and the structure of elements around the antenna in the device. Referring to FIG. 3, which shows measured radiation patterns in the X-Y plane of such a conventional slot antenna operating at three frequencies, the center line of the radiation pattern rotates around the origin an angle θ from the Y-axis. Because of the altered radiation pattern, such a conventional slot antenna often cannot operate in its best mode.

Hence, an improved antenna is desired to overcome the above-mentioned shortcomings of existing antennas.

BRIEF SUMMARY OF THE INVENTION

A primary object, therefore, of the present invention is to provide an improved slot antenna having an irregular geometric shape for improving the operating characteristics of the slot antenna.

A slot antenna in accordance with the present invention comprises an antenna body and a coaxial feeder cable, wherein an elongated, narrow slot is defined in the antenna body and the cable has an inner core wire soldered to one side of the slot and an outer shield soldered to another side of the slot. The antenna body is made from a metal foil, and a plurality of notches is defined in the antenna body near the slot for changing the receiving angle and improving the gain value of the slot antenna.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
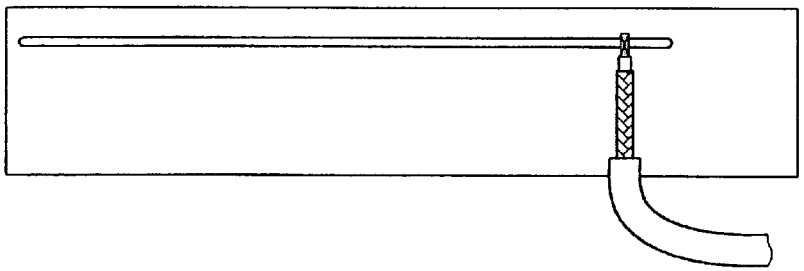
FIG. 1 is a top view of a conventional slot antenna.
Figure 2:
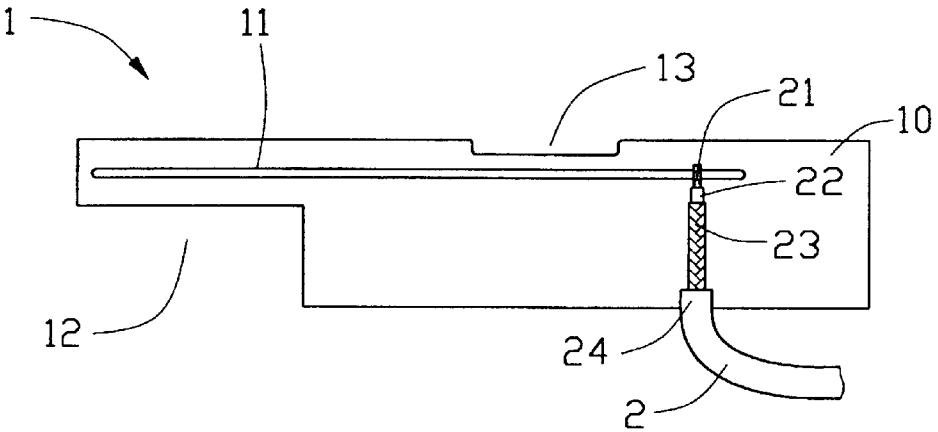
FIG. 2 is a top view of a slot antenna in accordance with the present invention.

Referring to FIG. 2, a slot antenna 1 in accordance with the present invention comprises an antenna body 10 and a coaxial feeder cable 2 electrically connected to the antenna body 10.

The antenna body 10 is made from a metal foil. An elongated, narrow slot 11 is defined in the antenna body 10. A first and second notches 12, 13 of predetermined geometric sizes and shapes are further defined in the antenna body 10 near the slot 11.

The coaxial feeder cable 2 comprises a conductive inner core 21, a conductive braiding layer 23, an inner dielectric layer 22 insulating the inner core 21 from the braiding layer 23, and an insulative outer jacket 24 surrounding the braiding layer 23. The inner core 21 and the braiding layer 23 are respectively soldered to the corresponding circuits on the antenna body 10 at two opposite sides of the slot 11.

Figure 3:
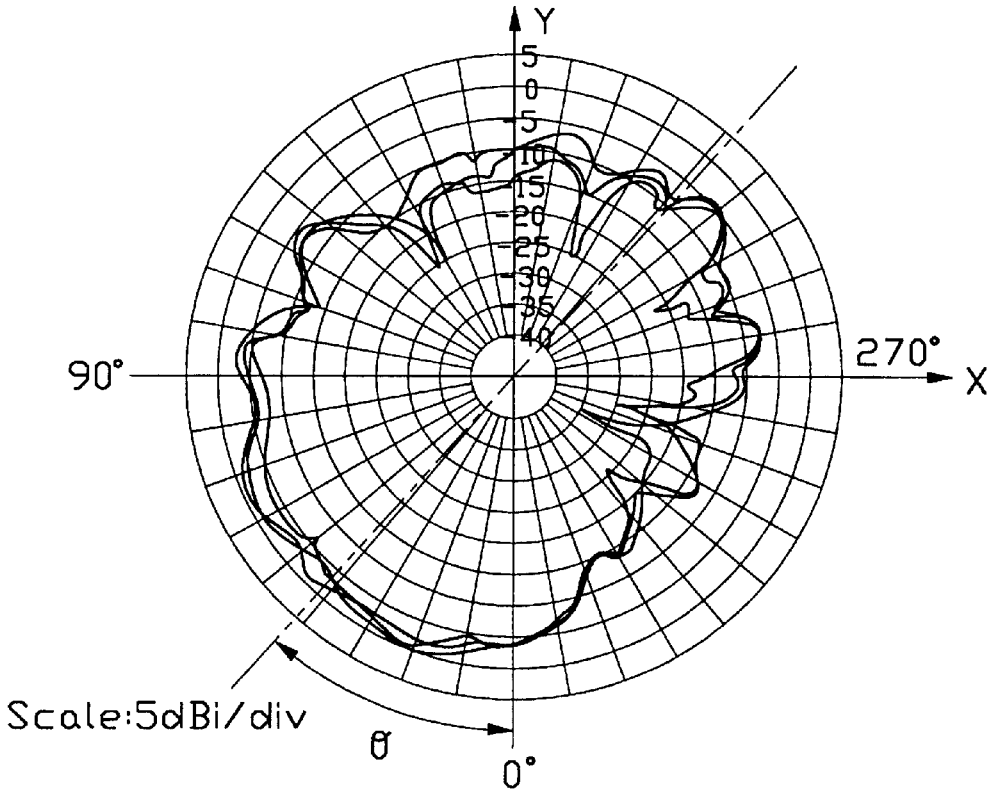
FIG. 3 shows measured radiation patterns in the X-Y plane of the conventional slot antenna of FIG. 1 operating at three frequencies, wherein a dash-dotted line shows the center line of the radiation patterns.
Figure 4:
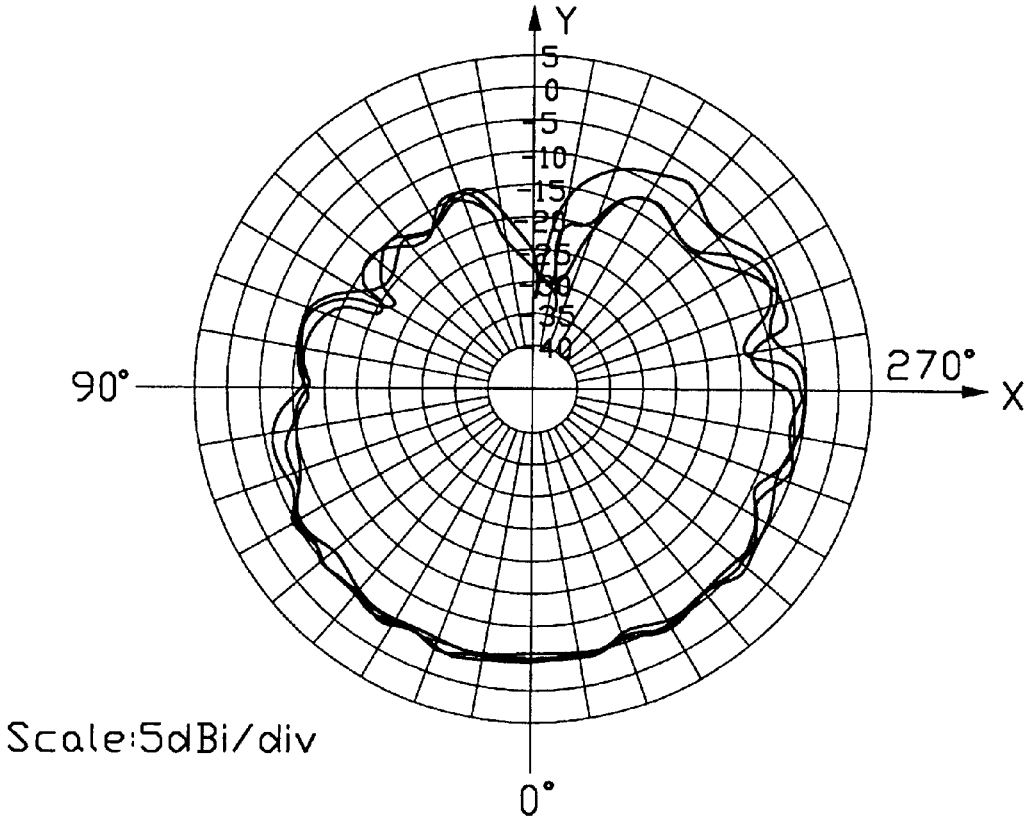
FIG. 4 shows measured radiation patterns in the X-Y plane of the slot antenna of FIG. 2 operating at three frequencies.

FIG. 4 shows measured radiation patterns in the X-Y plane of the slot antenna 1 in accordance with the present invention, operating at frequencies of 2.40 GHz, 2.45 GHz and 2.50 GHz. Note that the center line of the radiation patterns align with the Y-axis. Compared with the patterns shown in FIG. 3 for the conventional antenna, the patterns for the slot antenna 1 of the present invention demonstrate higher maximum and average gain values, and directionality is improved.

It is noted that the presence of the first and second notches 12, 13 changes the electric current density near the slot 11 and thus changes the magnetic intensity produced by the electric current, so the directionality of the electromagnetic field is changed. Using the principle disclosed above, other notches, slots or holes of predetermined sizes can be cut in the antenna body 10, affecting the directionality of the slot antenna 1. Obvious variations of the slot antenna 1, including different notch or hole patterns, are thus intended to be covered by the present disclosure.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms which the appended claims are expressed.

What is claimed is:

1. A slot antenna for an electronic device, comprising:

an antenna body with an elongated closed type slot defined therein, wherein the slot has first and second elongated edges extending straightly and continuously in a same direction, and a distance measured perpendicular from the first or the second edge of the slot to an outer edge of the antenna body, is not constant due to presence of at least one additional slot, hole or notch present in the antenna body adjacent to the slot; and a coaxial feeder cable having a conductive inner core wire, an inner dielectric layer surrounding the inner core wire, and a conductive outer shield surrounding the inner dielectric layer, wherein the inner core wire is electrically connected to the antenna body on a first side of the slot and the outer shield is electrically connected to a second side of the slot.

2. A method for making a slot antenna, comprising the following steps:

providing a rectangular metal foil comprising four side edges and a body between the side edges;

cutting a closed type slot through the body of the metal foil along a longitudinal dimension of the foil;

cutting notches and holes in the edges and body of the rectangular metal foil; and providing a coaxial feeder cable having a conductive inner core wire, an inner dielectric layer surrounding the inner core wire, and a conductive outer shield surrounding the inner dielectric layer, electrically connecting the inner core wire to the metal foil on a first side of the slot and the outer shield to a second side of the slot.

3. A slot antenna comprising:

a printed circuit board defining a plane confined by a plurality of side edges with an elongated closed type slot extending in a first direction on the plane with two opposite lengthwise ends of said closed type slot terminated in the plane while said closed type slot extending through said printed circuit board in a second direction perpendicular to said plane;

a coaxial feeder cable having an inner signal conductor and an outer ground conductor respectively electrically connected to signal and ground circuits on said printed circuit board around said slot;

at least one cut-off formed in the printed circuit board to adjust directionality or better gain values of the radiation patterns of said slot antenna.

4. The slot antenna as claimed in claim 3, wherein said cut-off is formed around one portion of at least one of said side edges of the plane.

5. The slot antenna as claimed in claim 3, wherein said slot does not extend through said printed circuit board along a lengthwise direction thereof.

6. The slot antenna as claimed in claim 3, wherein said slot extends along a length direction of said printed circuit board on said plane.

7. The slot antenna as claimed in claim 3, wherein the signal circuit and the ground circuit are applied on two opposite sides of the slot.

8. The slot antenna as claimed in claim 3, wherein said slot generally defines two different distances with regard to the two corresponding opposite side edges by two sides thereof, while at least a portion of said slot defines the same distance with regard to two opposite edges of the printed circuit board by said two sides wherein at least one of said two opposite edges is formed by said at least one cut-off.

9. A method of adjusting directionality and obtaining better gain values of radiation patterns of a slot antenna, comprising the steps of:

providing a printed circuit board defining a direction on a plane thereon;

forming a closed type slot in said printed circuit board along said direction, said closed type slot extending through two opposite surfaces of said printed circuit board while peripherally restricted in the plane defined by said printed circuit board;

attaching a coaxial feeder cable to the printed circuit board with an inner conductor and an outer shield thereof respectively connected to signal and ground circuits of the printed circuit board around said slot; and forming at least one properly dimensioned opening at one selected position on the printed circuit board to comply with either a desired directionality or better gain values of the radiation patterns of said slot antenna.

10. The method as claimed in claim 9, wherein said opening communicates with an exterior in any direction on said plane.

* * * * *